US008388082B2

(12) United States Patent
Usuda et al.

(10) Patent No.: US 8,388,082 B2
(45) Date of Patent: Mar. 5, 2013

(54) FLUID EJECTING APPARATUS AND FLUID EJECTING METHOD

(75) Inventors: Hidenori Usuda, Matsumoto (JP); Hideo Noro, Minamiminowa-mura (JP); Toshio Kumagai, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 367 days.

(21) Appl. No.: 12/490,559

(22) Filed: Jun. 24, 2009

(65) Prior Publication Data

US 2009/0322810 A1 Dec. 31, 2009

(30) Foreign Application Priority Data

Jun. 25, 2008 (JP) ..... 2008-166316

(51) Int. Cl.
*B41J 25/308* (2006.01)

(52) U.S. Cl. ..... 347/8; 347/9; 347/19

(58) Field of Classification Search ..... 347/5, 9, 347/138, 234, 8, 19
See application file for complete search history.

(56) References Cited

U.S. PATENT DOCUMENTS

| | | | | |
|---|---|---|---|---|
| 4,752,804 | A * | 6/1988 | Ohno | 399/300 |
| 7,589,751 | B2 * | 9/2009 | Fukutome et al. | 347/138 |
| 7,753,516 | B2 * | 7/2010 | Yoneyama | 347/102 |

FOREIGN PATENT DOCUMENTS

| | | |
|---|---|---|
| JP | 03-221471 | * 9/1991 |
| JP | 10-278376 | 10/1998 |
| JP | 2001-253040 | 9/2001 |
| JP | 2007-320236 | 12/2007 |

* cited by examiner

*Primary Examiner* — Lam S Nguyen
(74) *Attorney, Agent, or Firm* — Workman Nydegger

(57) ABSTRACT

A fluid ejecting apparatus includes a rotatable drum that holds a medium on a periphery thereof, a head that ejects a fluid onto the medium held by the drum, a fixing portion that fixes the fluid ejected from the head onto the medium, an outer-radius measuring portion that measures an outer radius of the drum, an adjusting portion that adjusts a distance between the drum and the head, and a controller that causes the adjusting portion to adjust a distance between the head and the medium in accordance with a variation in the outer radius of the drum measured by the outer-radius measuring portion.

6 Claims, 10 Drawing Sheets

FLUID EJECTING APPARATUS AND FLUID EJECTING METHOD

CROSS-REFERENCE TO RELATED APPLICATION

The entire disclosure of Japanese Patent Application No. 2008-166316, filed Jun. 25, 2008 is expressly incorporated by reference herein.

BACKGROUND

1. Technical Field

The present invention relates to fluid ejecting apparatuses and fluid ejecting methods.

2. Related Art

In a fluid ejecting apparatus of the related art, a drum that holds a medium on the periphery thereof is rotated, and a fluid, such as ink, is ejected from a head towards the medium. One example of such a fluid ejecting apparatus is an inkjet printer that forms an image on a medium. In such a fluid ejecting apparatus, when ultraviolet curable ink is used as the fluid to be ejected from the head, ultraviolet light is emitted to the medium on the drum so as to facilitate the fixation of the ink landed on the medium. JP-A-2007-320236 is an example of the related art.

The ultraviolet light emitted towards the drum in this manner causes the temperature of the drum to increase. The effect of the heat causes the drum to expand, causing the outer radius of the drum to vary. Such a variation in the outer radius of the drum induces a variation in the distance between the outer surface of the drum and the head. When the distance between the outer surface of the drum and the head varies, the landing position of the fluid on the medium also varies. Such a variation in the landing position of the fluid on the medium unfavorably results in formation of a deformed image, different from the desired image, on the medium.

SUMMARY

An advantage of some aspects of the invention is that the fluid can be made to land on a proper position on the medium even when the outer radius of the drum varies.

According to an aspect of the invention, a fluid ejecting apparatus includes a rotatable drum that holds a medium on a periphery thereof, a head that ejects a fluid onto the medium held by the drum, a fixing portion that fixes the fluid ejected from the head onto the medium, an outer-radius measuring portion that measures an outer radius of the drum, an adjusting portion that adjusts a distance between the drum and the head, and a controller that causes the adjusting portion to adjust a distance between the head and the medium in accordance with a variation in the outer radius of the drum measured by the outer-radius measuring portion.

Other features of the invention will be clarified by this specification and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
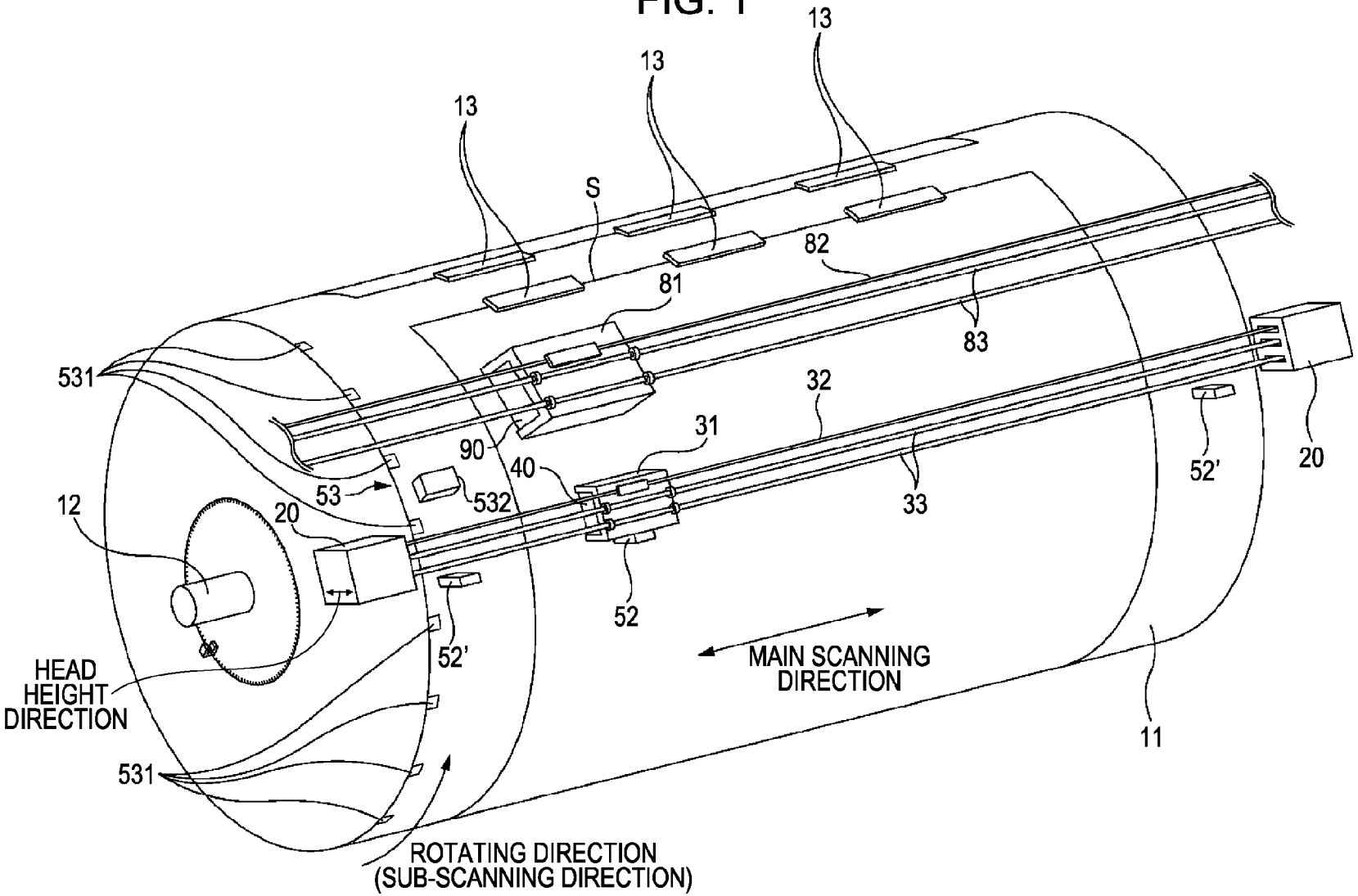
FIG. 1 schematically illustrates a printer 1.

The following is at least clarified by this specification and the attached drawings.

A fluid ejecting apparatus according to an embodiment of the invention includes a rotatable drum that holds a medium on a periphery thereof, a head that ejects a fluid onto the medium held by the drum, a fixing portion that fixes the fluid ejected from the head onto the medium, an outer-radius measuring portion that measures an outer radius of the drum, an adjusting portion that adjusts a distance between the drum and the head, and a controller that causes the adjusting portion to adjust a distance between the head and the medium in accordance with a variation in the outer radius of the drum measured by the outer-radius measuring portion.

Accordingly, the fluid can be made to land on a proper position on the medium even when the outer radius of the drum varies.

In the aforementioned fluid ejecting apparatus, the fixing portion is preferably a light-emitting device. More preferably, the fixing portion is an ultraviolet-light-emitting device.

Accordingly, the fluid can be made to land on a proper position on the medium even when the outer radius of the drum varies.

A fluid ejecting apparatus according to another embodiment of the invention includes a rotatable drum that holds a medium on a periphery thereof, a head that ejects a fluid onto the medium held by the drum, a fixing portion that fixes the fluid ejected from the head onto the medium, a peripheral-speed measuring portion that measures a peripheral speed at the periphery of the drum corresponding to an outer radius thereof, an adjusting portion that adjusts a distance between the drum and the head, and a controller that causes the adjusting portion to adjust a distance between the head and the medium in accordance with a variation in the peripheral speed measured by the peripheral-speed measuring portion.

Accordingly, the fluid can be made to land on a proper position on the medium even when the outer radius of the drum varies.

A fluid ejecting method according to an embodiment of the invention includes rotating a medium while holding the medium on a periphery of a drum, ejecting a fluid from a head onto the medium held by the drum, fixing the fluid ejected from the head onto the medium, measuring an outer radius of the drum, and adjusting a distance between the head and the medium in accordance with a variation in the outer radius of the drum.

Accordingly, the fluid can be made to land on a proper position on the medium even when the outer radius of the drum varies.

A fluid ejecting method according to another embodiment of the invention includes rotating a medium while holding the medium on a periphery of a drum, ejecting a fluid from a head onto the medium held by the drum, fixing the fluid ejected from the head onto the medium, measuring a peripheral speed at the periphery of the drum corresponding to an outer radius thereof, and adjusting a distance between the head and the medium in accordance with a variation in the measured peripheral speed at the periphery of the drum corresponding to the outer radius thereof.

Accordingly, the fluid can be made to land on a proper position on the medium even when the outer radius of the drum varies.

Embodiments

Printer 1

Figure 2:
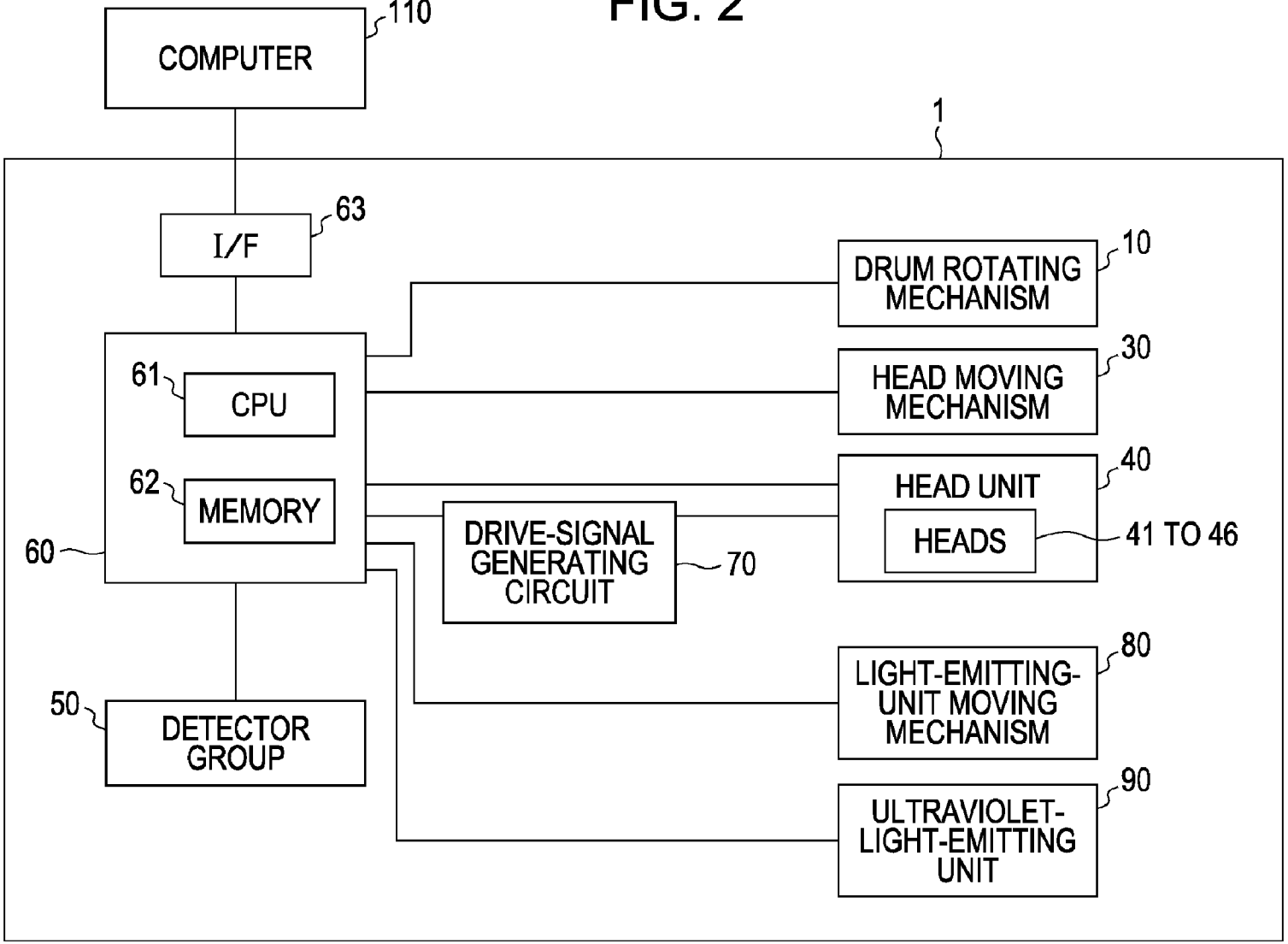
FIG. 2 is a block diagram of the overall configuration of the printer 1.

FIG. 1 schematically illustrates a printer 1. FIG. 2 is a block diagram of the overall configuration of the printer 1. The printer 1 will be described below with reference to FIGS. 1 and 2.

The printer 1 includes a drum rotating mechanism 10, a head moving mechanism 30, a head unit 40, a detector group 50, a controller 60, an interface 63, a drive-signal generating circuit 70, a light-emitting-unit moving mechanism 80, and an ultraviolet-light-emitting unit 90.

The drum rotating mechanism 10 is configured to rotate a drum 11 at a predetermined speed under the control of the controller 60. The drum rotating mechanism 10 includes the drum 11 and a motor (not shown). An output shaft of the motor is coupled to a rotary shaft 12 of the drum 11. The controller 60 controls the motor so as to control the rotational angular speed of the drum 11.

The drum 11 holds a medium, such as a sheet S, on the periphery thereof. The medium is held in place by, for example, having its edges pinched between a holding device 13 and the periphery of the drum 11. Alternatively, the medium may be held in place by using a vacuum suction mechanism. In that case, small holes are formed in the periphery of the drum 11 and the medium is attached to the periphery of the drum 11 by suction through the holes.

To provide an easier understanding of this embodiment, the description below is based on the assumption that the thickness of the medium is extremely small and the outer radius of the drum 11 includes the thickness of the medium.

A height adjusting mechanism 20 is configured to move a guide 33 in a head-height direction, as shown in FIG. 1, so as to adjust the distance between the head unit 40 and the drum 11. The head-height direction is a direction that extends toward the central axis of the drum 11. The height adjusting mechanism 20 includes a motor (not shown), a worm gear attached to the motor, a worm wheel, and a rack-and-pinion mechanism. An output shaft of the worm wheel is connected to a shaft of a pinion gear in the rack-and-pinion mechanism. By rotating the motor, a rack can be moved in the head-height direction. The rack has the guide 33 attached thereto. Since the rotation of the motor is controlled by the controller 60, the position of the guide 33 is adjustable in the head-height direction under the control of the controller 60.

The height adjusting mechanism 20 is also provided with a mechanism that can move a belt 32 in the head-height direction simultaneously as the guide 33 moves in the head-height direction.

The head moving mechanism 30 is equipped with a carriage 31 for holding the head unit 40. The carriage 31 has the belt 32 attached thereto. The carriage 31 holds the guide 33 in a slidable fashion so that the carriage 31 is capable of moving in the extending direction of the guide 33 (i.e., a main scanning direction). The belt 32 can be moved in the main scanning direction by an output from a motor (not shown). When the belt 32 moves in the main scanning direction, the carriage 31 also moves in the main scanning direction. Since the movement of the belt 32 is controlled by the controller 60, the head unit 40 is also moved in the main scanning direction under the control of the controller 60.

The head unit 40 is constituted by six heads 41 to 46. Each of these heads 41 to 46 ejects ink so as to form an image on the medium. The head unit 40 is connected to the controller 60 and the drive-signal generating circuit 70 by means of cables (not shown), so as to receive a drive signal COM and a signal for controlling ink ejection. The head unit 40 according to this embodiment is configured to eject ultraviolet curable ink (UV ink).

The detector group 50 includes detectors, such as a rotary encoder 51, an outer-radius measuring device 52, and a peripheral-speed measuring device 53.

Figure 3:
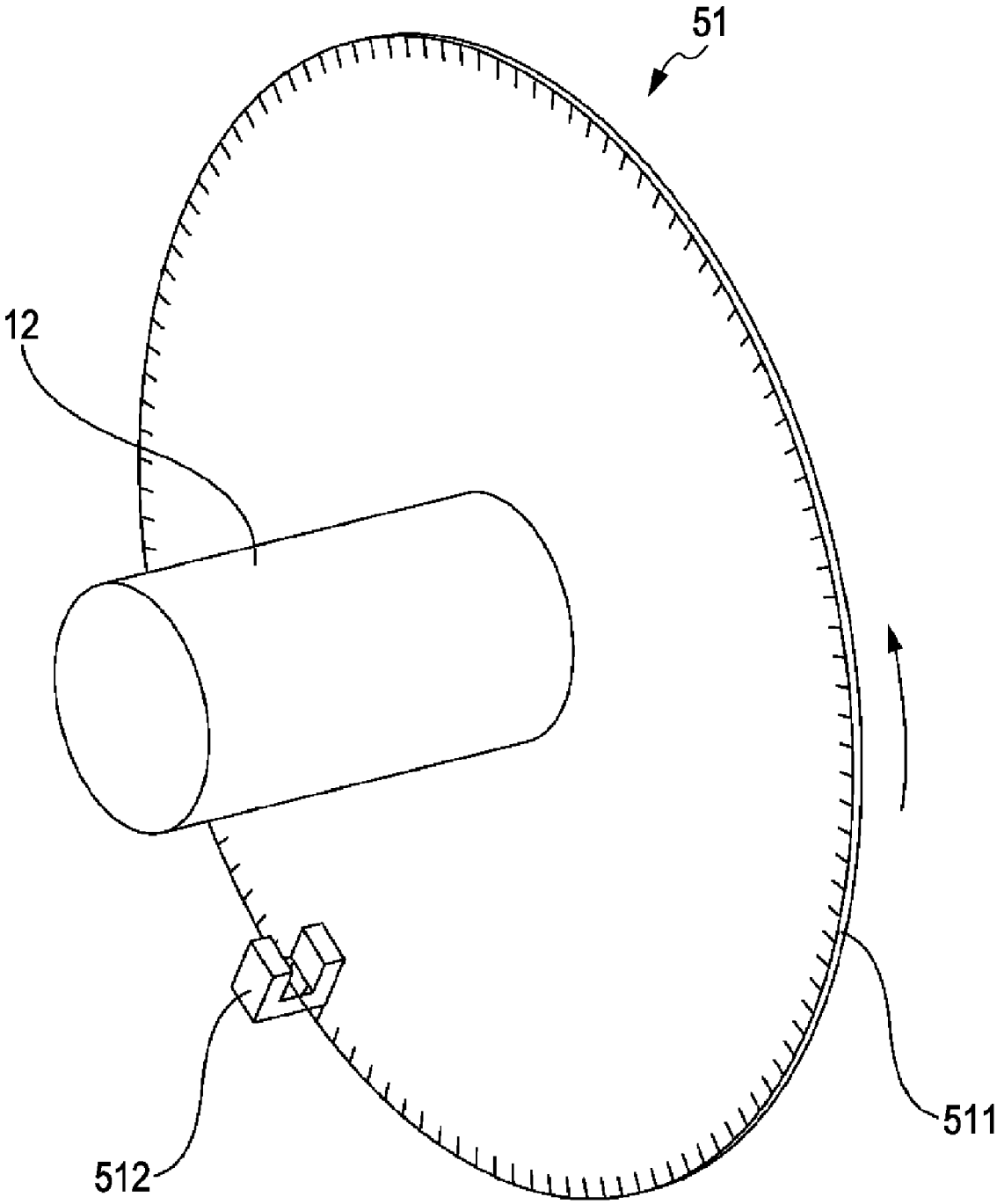
FIG. 3 illustrates a rotary encoder 51.

FIG. 3 illustrates the rotary encoder 51. The rotary encoder 51 includes a rotating disc 511 having multiple slits arranged at predetermined intervals, and a detecting portion 512. The rotating disc 511 is fixed to the rotary shaft 12 of the drum 11 and is configured to rotate with the drum 11. The detecting portion 512 is fixed to the printer 1. The rotary encoder 51 outputs a pulse signal ENC to the controller 60 every time one of the slits provided in the rotating disc 511 passes the detecting portion 512. Based on this pulse signal ENC, the controller 60 can perform various control of the printer 1.

Figure 4:
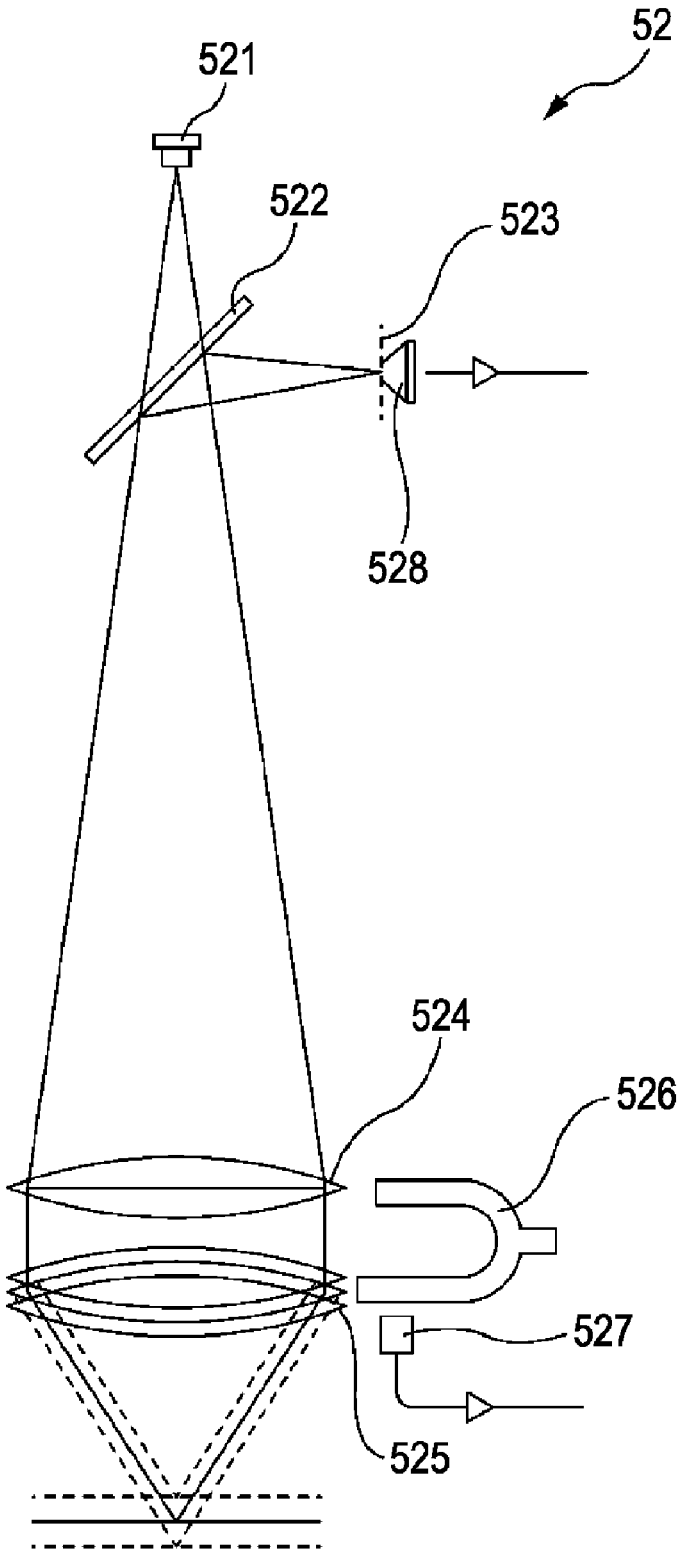
FIG. 4 illustrates an outer-radius measuring device 52 of a laser focus type.

FIG. 4 illustrates the outer-radius measuring device 52 of a laser focus type. The outer-radius measuring device 52 includes a semiconductor laser 521, a half mirror 522, a pin hole 523, a light-receiving element 528, and an amplifier for amplifying a light reception signal. The outer-radius measuring device 52 also includes a collimator lens 524, an objective lens 525, a tuning fork 526, a tuning-fork position sensor 527, and an amplifier for amplifying a position signal.

The semiconductor laser 521 emits a laser beam towards an object subjected to distance measurement. The emitted laser beam travels through the objective lens 525, which is moved vertically at high speed by the tuning fork 526, so as to be focused on the object. After being reflected by the object, the laser beam travels through the half mirror 522 and the pin hole 523 so as to enter the light-receiving element 528. In this case, when the laser beam is focused on the object, the reflected light thereof is collected at a point at the pin hole 523 before it enters the light-receiving element 528. At the same time, the tuning-fork position sensor 527 detects the position of the tuning fork 526, whereby the distance to the object can be measured. The distance to the object is measured for each position of the tuning fork 526 so that a drum radius (outer radius) for each position can be determined on the basis of the measured distance. The drum radius is then sent to the controller 60.

The outer-radius measuring device 52 is attached to the carriage 31 and is configured to move together with the carriage 31 in the main scanning direction. The outer-radius measuring device 52 is capable of obtaining the outer radius of the drum 11 for each position of the head unit 40. Since the drum 11 is rotatable, the outer-radius measuring device 52 is capable of obtaining the outer radius for each position on the periphery of the drum 11.

Alternatively, the outer-radius measuring device 52 may be a mechanical measuring device of a contact type that has a section contactable with the outer surface of the drum 11.

The peripheral-speed measuring device 53 is configured to measure the peripheral speed of the drum 11. The term "peripheral speed" refers to a linear speed in the rotating direction at the periphery of the drum 11. The peripheral-speed measuring device 53 includes a plurality of peripheral-speed measuring markers 531 provided along the periphery of the drum 11 and a marker detecting portion 532. The peripheral-speed measuring markers 531 are arranged at predetermined intervals on the periphery of the drum 11. The marker detecting portion 532 is configured to detect the peripheral-speed measuring markers 531 during the rotation of the drum 11, and to measure the time period between a point which a certain peripheral-speed measuring marker 531 is detected and a point at which a subsequent peripheral-speed measuring marker 531 is detected. Based on the distance (gap) between the two peripheral-speed measuring markers 531 and the measured time period, the peripheral speed of the drum 11 can be determined. The determined peripheral speed of the drum 11 is sent to the controller 60.

The controller 60 is configured to control various sections of the printer 1, and includes a central processing unit (CPU) 61 and a memory 62. The memory 62 stores data and a program for operating the printer 1. The CPU 61 executes the program stored in the memory 62 so as to control the various sections of the printer 1 and perform printing.

While the outer radius of the drum 11 and the peripheral speed of the drum 11 are obtainable in this embodiment, the controller 60 is capable of adjusting the position of the head unit 40 in the head-height direction in accordance with these detection values.

The interface 63 is configured to connect the controller 60 of the printer 1 and a computer 110.

The computer 110 sends print data of an image to be printed to the printer 1 via a printer driver. The print data contains pixel data that specifies the sizes of ink droplets of respective ink colors to be ejected for each pixel on the medium.

The drive-signal generating circuit 70 is configured to generate a drive signal COM. The drive-signal generating circuit 70 obtains data related to a waveform of a drive signal COM from the controller 60. Based on this data related to the waveform, the drive-signal generating circuit 70 generates a voltage signal and amplifies it to generate a drive signal COM. An example of the waveform of the drive signal COM will be described later.

The light-emitting-unit moving mechanism 80 is equipped with a carriage 81 for holding the ultraviolet-light-emitting unit 90. The carriage 81 has a belt 82 attached thereto. The carriage 81 holds a guide 83 in a slidable fashion so that the carriage 81 is capable of moving in the extending direction of the guide 83 (i.e., the main scanning direction). The belt 82 can be moved in the main scanning direction by an output from a motor (not shown). When the belt 82 moves in the main scanning direction, the carriage 81 also moves in the main scanning direction. Since the movement of the belt 82 is controlled by the controller 60, the ultraviolet-light-emitting unit 90 is also moved in the main scanning direction under the control of the controller 60. Specifically, the light-emitting-unit moving mechanism 80 moves the ultraviolet-light-emitting unit 90 such that the position thereof in the main scanning direction is aligned with the position of the head 41. Thus, UV ink ejected from the heads 41 to 46 and landed on the medium can be cured by ultraviolet light.

The ultraviolet-light-emitting unit 90 is configured to emit ultraviolet light towards the UV ink ejected on the medium so as to cure the UV ink. The ultraviolet-light-emitting unit 90 may be defined by, for example, a metal halide lamp or a light-emitting diode. The emission rate of ultraviolet light from the ultraviolet-light-emitting unit 90 can be controlled by the controller 60. Thus, the quantity of ultraviolet light to be emitted can be varied depending on different positions on the medium. This ultraviolet-light-emitting unit 90 corresponds to a fixing portion.

Arrangement of Heads

Figure 5A:
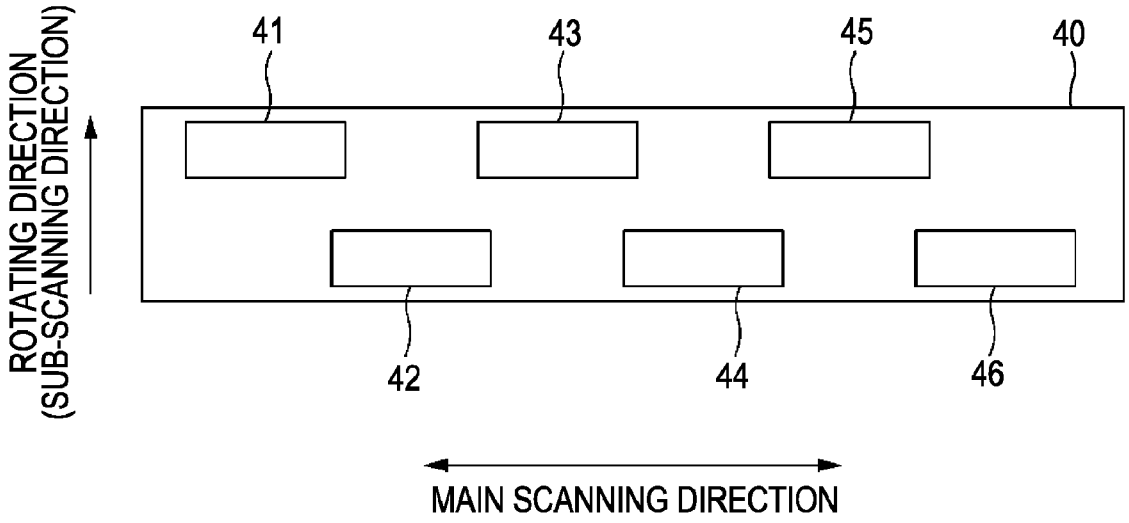
FIG. 5A illustrates a head unit 40.

FIG. 5A illustrates the head unit 40. The head unit 40 includes the first to sixth heads 41 to 46. Specifically, FIG. 5A is a top view of the head unit 40. Although the heads 41 to 46 in the head unit 40 are actually blocked by other components and are not viewable, the first to sixth heads 41 to 46 are shown in a viewable state in FIG. 5A in order to facilitate the description.

The first to sixth heads 41 to 46 are arranged in the main scanning direction. In detail, the odd-numbered heads 41, 43, and 45 and the even-numbered heads 42, 44, and 46 are deviated from each other in a sub-scanning direction so that the nozzle spacing from one end of the first head 41 to one end of the sixth head 46 is constantly fixed in the main scanning direction.

Figure 5B:
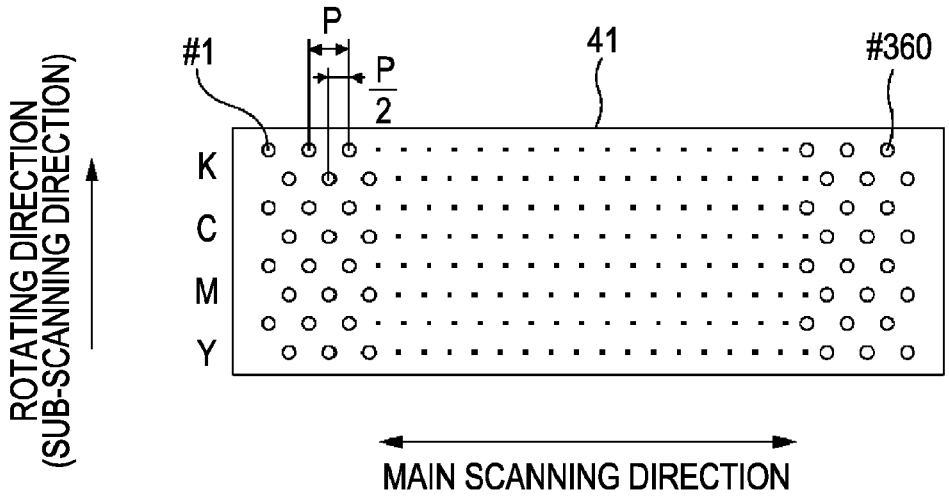
FIG. 5B illustrates a nozzle arrangement in a first head 41.

FIG. 5B illustrates a nozzle arrangement in the first head 41. Specifically, FIG. 5B is a top view of the first head 41. Although the nozzles in the first head 41 are actually blocked by other components and are not viewable, the nozzles are shown in a viewable state in FIG. 5B in order to facilitate the description.

The first head 41 includes nozzle arrays for yellow (Y) magenta (M), cyan (C), and black (K) colors. The first head 41 has two nozzle arrays for each ink color. Each nozzle array has a nozzle pitch P of 360 dpi. With regard to each ink color in the first head 41, the nozzles in one nozzle array are arranged between the nozzles in the other nozzle array so that a nozzle pitch of P/2 is achieved in the main scanning direction. Consequently, in this embodiment, a nozzle pitch of 720 dpi is achieved in the main scanning direction.

The second to sixth heads 42 to 46 have the same configuration as the first head 41. The first head 41 and the second head 42 are disposed such that the nozzle pitch between a nozzle #360 of the first head 41 and a nozzle #1 of the second head 42 is equal to P. The second to sixth heads 42 to 46 are disposed in a similar fashion so that the nozzles from the one end of the first head 41 to the one end of the sixth head 46 are arranged at a nozzle pitch of 720 dpi in the main scanning direction.

Structure of Heads

Figure 6:
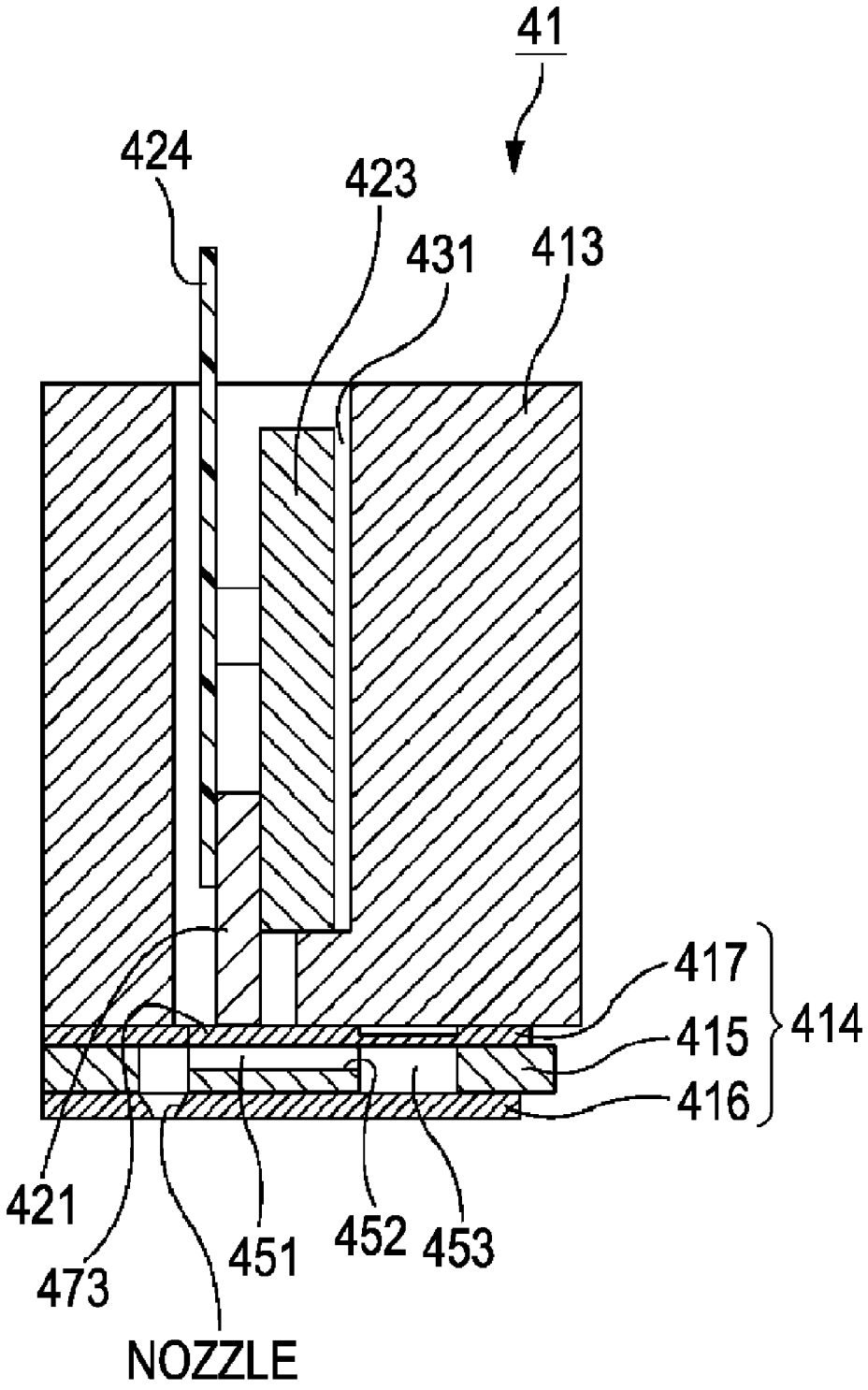
FIG. 6 is a cross-sectional view of one of nozzle arrays and its surrounding area.

FIG. 6 is a cross-sectional view of one of nozzle arrays and its surrounding area. A structure of a drive unit provided for ejecting ink from the individual nozzles in the first head 41 will be described here with reference to FIG. 6.

The drive unit includes a plurality of piezo elements 421, a stationary plate 423 on which the piezo elements 421 are fixed, and a flexible cable 424 for supplying power to each piezo element 421. Each piezo element 421 is attached to the stationary plate 423 in a so-called cantilevered fashion. The stationary plate 423 is a tabular member having enough rigidity to withstand reaction force from the piezo elements 421. The flexible cable 424 is a wiring substrate in the form of a sheet having flexibility. A side surface of a fixed end, which is located opposite the stationary plate 423, of the flexible cable 424 is electrically connected to each piezo element 421. A head control portion (not shown), which is a control integrated circuit (IC) for controlling the driving of each piezo element 421, is mounted on a surface of the flexible cable 424. The head control portion is provided for every nozzle group in each head.

A channel unit 414 includes a channel-forming substrate 415, a nozzle plate 416, and an elastic plate 417, which are stacked in a manner such that the channel-forming substrate 415 is interposed between the nozzle plate 416 and the elastic plate 417. The nozzle plate 416 is a thin stainless-steel plate having nozzles.

The channel-forming substrate 415 has a plurality of openings, which are to form pressure chambers 451 and ink supply ports 452, in correspondence to the nozzles. A reservoir 453 serves as a liquid reservoir chamber for supplying ink retained in an ink cartridge to each pressure chamber 451. The reservoir 453 communicates with another end of each pressure chamber 451 via the corresponding ink supply port 452. The ink from the ink cartridge travels through an ink supply tube (not shown) so as to be introduced into the reservoir 453. The elastic plate 417 has an island section 473. A free end of each piezo element 421 is bonded to this island section 473.

When a drive signal is supplied to one of the piezo elements 421 via the flexible cable 424, the piezo element 421 expands and contracts, causing the volume of the corresponding pressure chamber 451 to increase and decrease. This change in the volume of the pressure chamber 451 causes pressure fluctuation to occur in the ink contained in the pressure chamber 451. By utilizing such pressure fluctuation in the ink, the ink can be ejected from the corresponding nozzle.

In this embodiment, the ink is supplied to each of the heads 41 to 46 with some pressure. In consequence, even when the head unit 40 is placed sideways as in this embodiment, the ink can be properly supplied thereto so that the ink can be properly ejected from each of the heads 41 to 46.

Drive Signal

Figure 7:
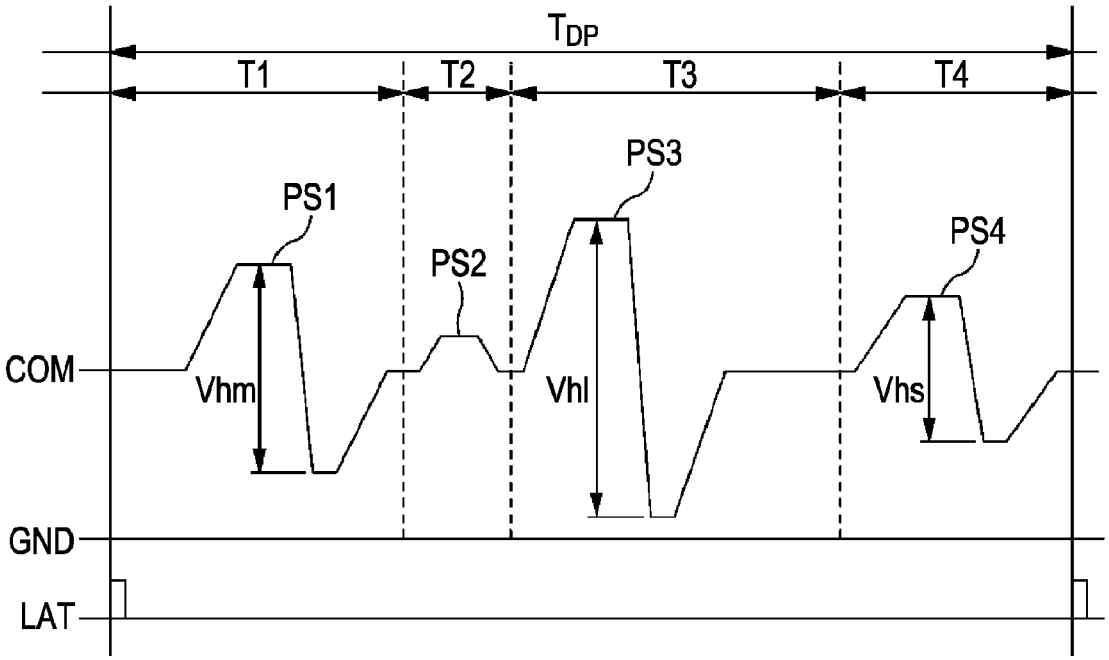
FIG. 7 illustrates an example of a drive signal COM generated by a drive-signal generating circuit 70.

FIG. 7 illustrates an example of the drive signal COM generated by the drive-signal generating circuit 70. As shown in FIG. 7, the drive signal COM is generated for every repetitive cycle $T_{DP}$.

A period $T_{DP}$, which is a repetitive cycle, corresponds to a period during which a nozzle moves by a distance equivalent to one pixel. For example, if the print resolution is 720 dpi, the period $T_{DP}$ corresponds to a period in which a nozzle moves by 1/720 inches relative to the sheet S. Based on pixel data contained in print data, drive pulses PS1 to PS4 in respective segments included in the period $T_{DP}$ are applied to each piezo element 421 so that ink droplets of different sizes are ejected to each pixel, whereby the pixel can be expressed in multiple gray scales.

The drive signal COM includes the drive pulse PS1 generated in a segment T1 of the period $T_{DP}$, the drive pulse PS2 generated in a segment T2 of the period $T_{DP}$, the drive pulse PS3 generated in a segment T3 of the period $T_{DP}$, and the drive pulse PS4 generated in a segment T4 of the period $T_{DP}$.

In FIG. 7, the amplitude of the drive pulse PS1 is denoted by Vhm, the amplitude of the drive pulse PS3 is denoted by Vh1, and the amplitude of the drive pulse PS4 is denoted by Vhs. Since an amount of change in each piezo element 421 increases with increasing amplitude of a drive pulse, an ink droplet to be ejected increases in size accordingly. Therefore, the ink droplets to be ejected can have different sizes depending on the amplitudes of the respective drive pulses. In FIG. 7, the amplitude Vh1 of the drive pulse PS3 is the largest, the amplitude Vhm of the drive pulse PS1 is the second largest, and the amplitude Vhs of the drive pulse PS4 is the third largest.

Therefore, when forming a small-size dot, the drive pulse PS4 is applied to the piezo element 421. When forming a mid-size dot, the drive pulse PS1 is applied to the piezo element 421. When forming a large-size dot, the drive pulse PS3 is applied to the piezo element 421. The drive pulse PS2 is a micro-vibration pulse for micro-vibrating a meniscus and is applied to the piezo element 421 when no dots are to be formed. Accordingly, the drive pulse PS4 is used for ejecting an ink droplet of a small-size dot, the drive pulse PS1 is used for ejecting an ink droplet of a mid-size dot, and the drive pulse PS3 is used for ejecting an ink droplet of a large-size dot.

The drive signal COM is generated on the basis of a timing for generating a latch signal LAT.

Printing Method

Figure 8:
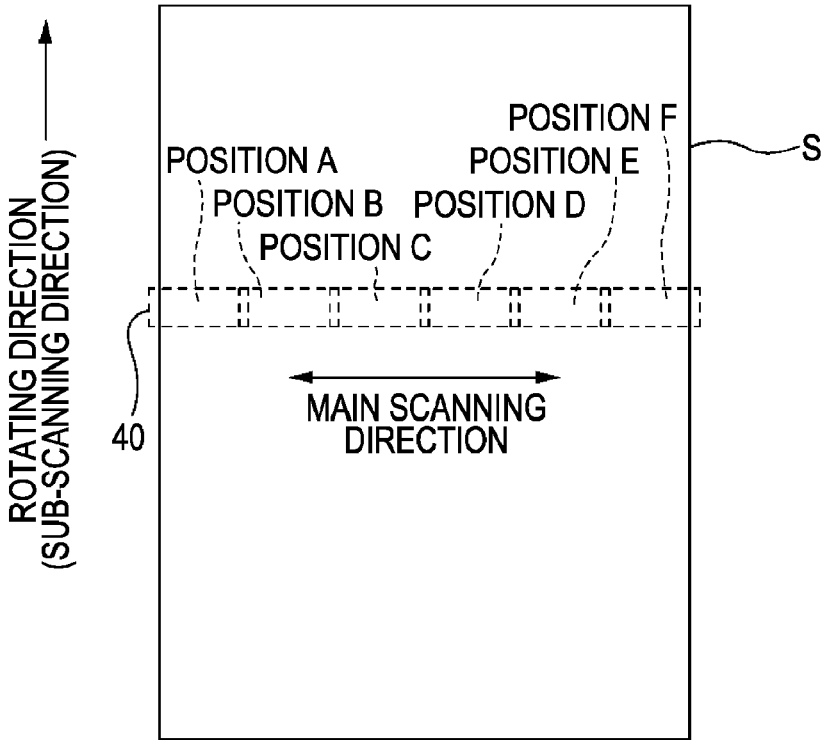
FIG. 8 illustrates the positioning of the head unit 40 relative to a sheet S during printing.

FIG. 8 illustrates the positioning of the head unit 40 relative to the sheet S during printing. Although there are various methods for performing printing on the sheet S held by the drum 11, the description below will be directed to an image forming method as an example.

First, the sheet S is set on the drum 11 to commence printing. Then, the drum 11 starts to rotate. When the drum 11 reaches a constant rotation speed, the head unit 40 moves to a position A shown in FIG. 8 and stays at the position A to eject ink droplets. Since the sheet S is held and rotated by the drum 11, printing is performed in the sub-scanning direction including the position A. In this case, ink is ejected while the drum 11 is rotated several times to several hundreds of times until the printing in the sub-scanning direction including the position A is completed. Upon completion of the printing in the sub-scanning direction including the position A, the head unit 40 is moved to a position B. Then, printing in the sub-scanning direction including the position B is performed in a similar manner to the printing performed at the position A. This process is performed up to a position F so that printing is performed on the entire sheet S.

Although printing is performed by moving the head unit 40 sequentially from the position A to the position F, the printing may be performed by moving the head unit 40 dispersedly in the main scanning direction instead of moving the head unit 40 sequentially from the position A to the position F.

As the head unit 40 moves, the ultraviolet-light-emitting unit 90 is also moved in the main scanning direction by the light-emitting-unit moving mechanism 80 so that the position thereof in the main scanning direction is aligned with the position of the head unit 40 in the main scanning direction. The ultraviolet-light-emitting unit 90 emits ultraviolet light towards the UV ink landed on the sheet S so as to cure the UV ink. The emission rate of ultraviolet light is freely adjustable within a range between 0% and 100%. In consequence, ultraviolet light can be emitted to the sheet S by a quantity suitable for an image formed on the sheet S.

When printing is performed by moving the head unit 40 in the main scanning direction of the drum 11 in this manner, the ultraviolet-light-emitting unit 90 is made to emit ultraviolet light while also moving in the main scanning direction of the drum 11. Since the emission rate of ultraviolet light is adjustable depending on a picture to be formed, a difference in temperature can occur on the drum 11, such as one region of the drum 11 being higher in temperature than the remaining regions. Because the drum radius increases with increasing temperature but decreases with decreasing temperature, the drum radius can vary depending on different locations due to such a temperature difference.

Figure 9:
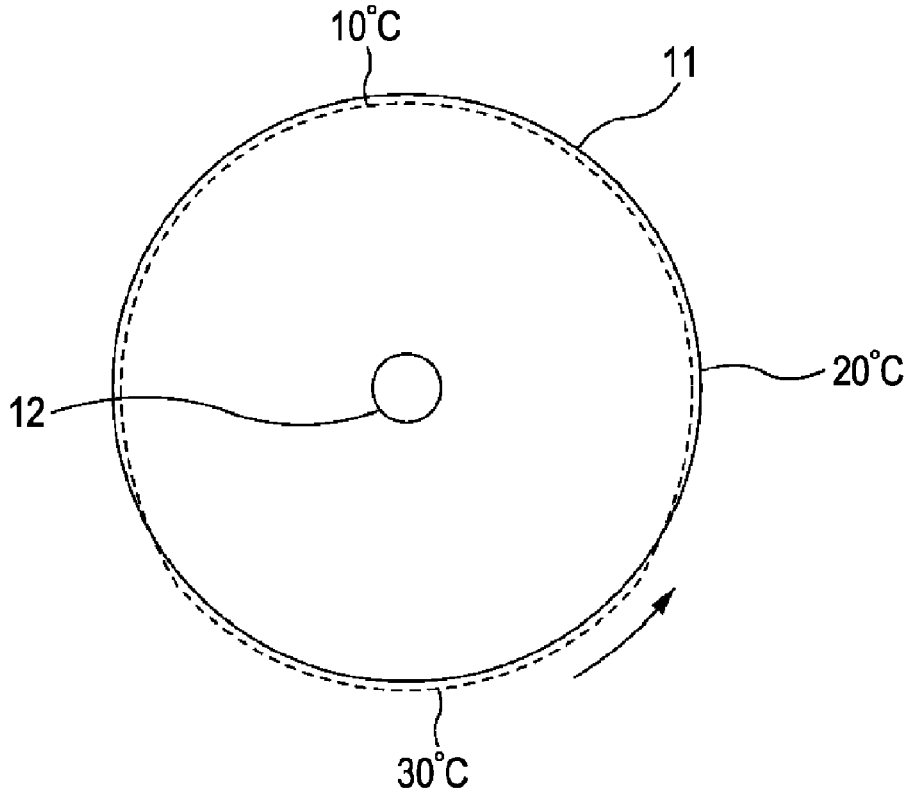
FIG. 9 illustrates various outer radii of a drum 11 depending on different temperatures.

FIG. 9 illustrates various outer radii of the drum 11 depending on different temperatures. In FIG. 9, the outer radius of the drum 11 when the temperature is 20° C. is shown as a reference radius indicated by a solid line. A dash line in FIG. 9 indicates that the outer radius of a part of the drum 11 is smaller when the temperature thereof is 10° C., as compared with when the temperature of the drum 11 is 20° C. The dash line also indicates that the outer radius of another part of the drum 11 is larger when the temperature thereof is 30° C., as compared with when the temperature of the drum 11 is 20° C. Accordingly, since the emission rate of ultraviolet light varies depending on different locations of the drum 11, a temperature difference occurs between these locations of the drum 11.

Figure 10:
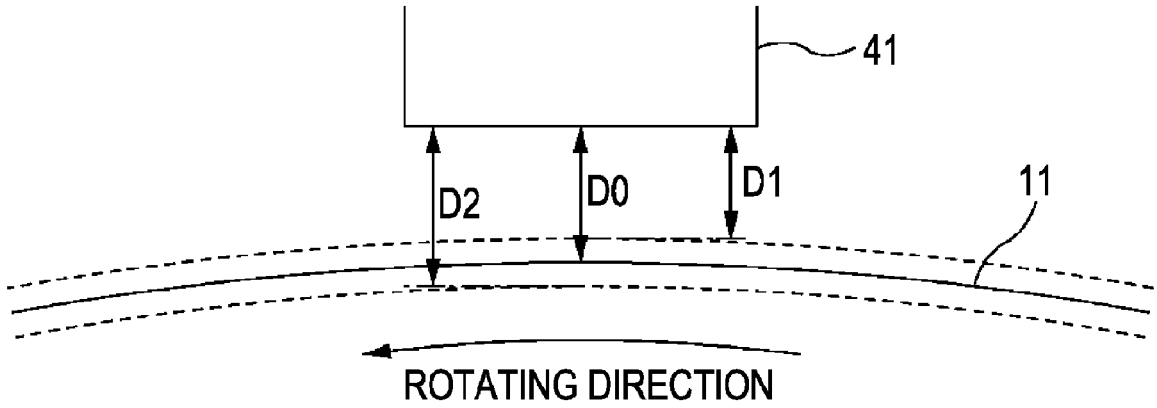
FIG. 10 illustrates various distances from the first head 41 of the head unit 40 to an outer surface of the drum 11.

FIG. 10 illustrates various distances from the first head 41 of the head unit 40 to the outer surface of the drum 11. In FIG. 10, a distance D0 indicates the distance between the first head 41 and the outer surface of the drum 11 when the radius of the drum 11 is equal to the reference radius. On the other hand, a distance D1 indicates the distance between the first head 41 and the outer surface of the drum 11 when the drum radius is increased due to a temperature increase. Moreover, a distance D2 indicates the distance between the first head 41 and the outer surface of the drum 11 when the drum radius is decreased due to a temperature decrease. Because the radius of the drum 11 varies depending on the temperature in this manner, the distance between the first head 41 and the outer surface of the drum 11 is variable. This means that the landing position of an ink droplet ejected from a head towards a sheet is variable depending on the temperature. Because the temperature of the drum 11 varies depending on different locations on the outer surface of the drum 11, the landing position of ink droplets can vary depending on these locations, resulting in printing of a deformed image different from the desired image.

Figure 11:
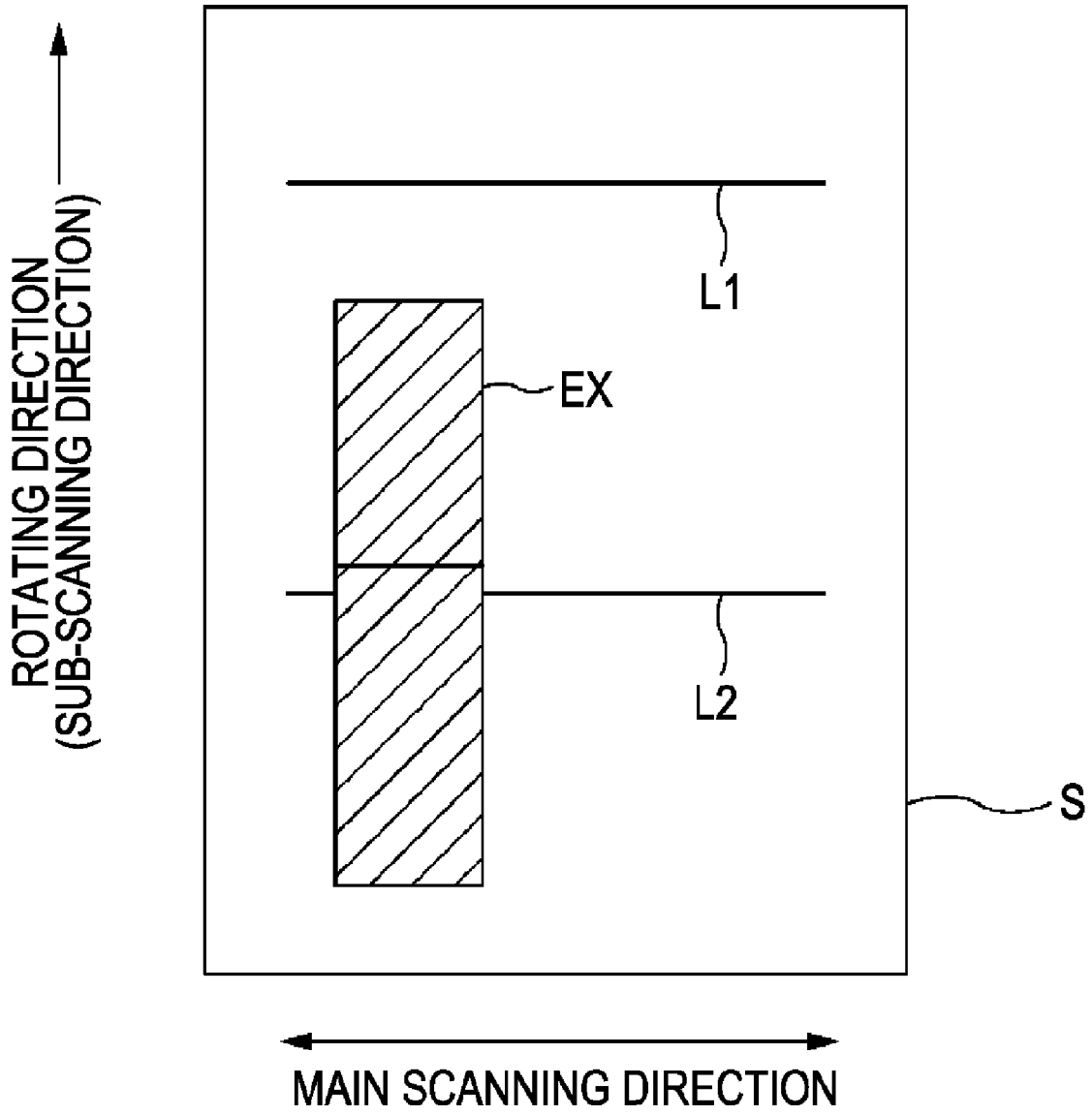
FIG. 11 illustrates an effect a variation in the outer radius of the drum 11 can have on image formation.

FIG. 11 illustrates an effect a variation in the outer radius of the drum 11 can have on image formation. FIG. 11 is a development view of the sheet S held by the drum 11. A shaded region EX on the sheet S corresponds to a region of the drum 11 having a radius larger than the reference radius due to partial expansion of the drum 11. On the other hand, the remaining non-shaded region of the sheet S corresponds to a region of the drum 11 where the radius thereof is equal to the reference radius.

When the radius of the drum 11 is equal to the reference radius across the main scanning direction, no deviation of dots occurs in the rotating direction (i.e., the sub-scanning direction). This is because the distance between the head and the outer surface of the drum 11 is constantly equal to D0, as shown in FIG. 10, across the main scanning direction. Therefore, when forming a line L1 extending in the main scanning direction in this region, a line without any deviation in the sub-scanning direction can be formed.

On the other hand, a certain region of the drum 11, like a region thereof corresponding to the region EX, can sometimes have a radius different from that of other regions. In that case, the outer surface of the drum 11 corresponding to the region EX is separated from the heads by the distance D1 (see FIG. 10), instead of the outer surface of the drum 11 being separated from the heads by the distance D0 when the radius of the drum 11 is equal to the reference radius (see FIG. 10). This means that an ink droplet will land on the region EX quicker than it would land on the region corresponding to the reference radius. Therefore, even if a line similar to the aforementioned line L1 is to be formed on the sheet S, the line will be deviated in the sub-scanning direction in the region EX, as compared with the line L1 formed in the remaining region.

Accordingly, when the radius of the drum 11 varies depending on different locations on the periphery of the drum 11, the dots are formed in a deviated form, meaning that the resultant image will be different from the desired image. In light of this, according to this embodiment, the outer radius of the drum 11 is measured by the outer-radius measuring device 52. In addition, the peripheral speed at the periphery of the drum 11 (i.e., the linear speed at the periphery of the drum 11 corresponding to the outer radius thereof) is measured by the peripheral-speed measuring device 53. Furthermore, the controller 60 is configured to adjust the height of the head unit 40 in accordance with these measured values.

Adjustment of Heads in Height Direction

Figure 12:
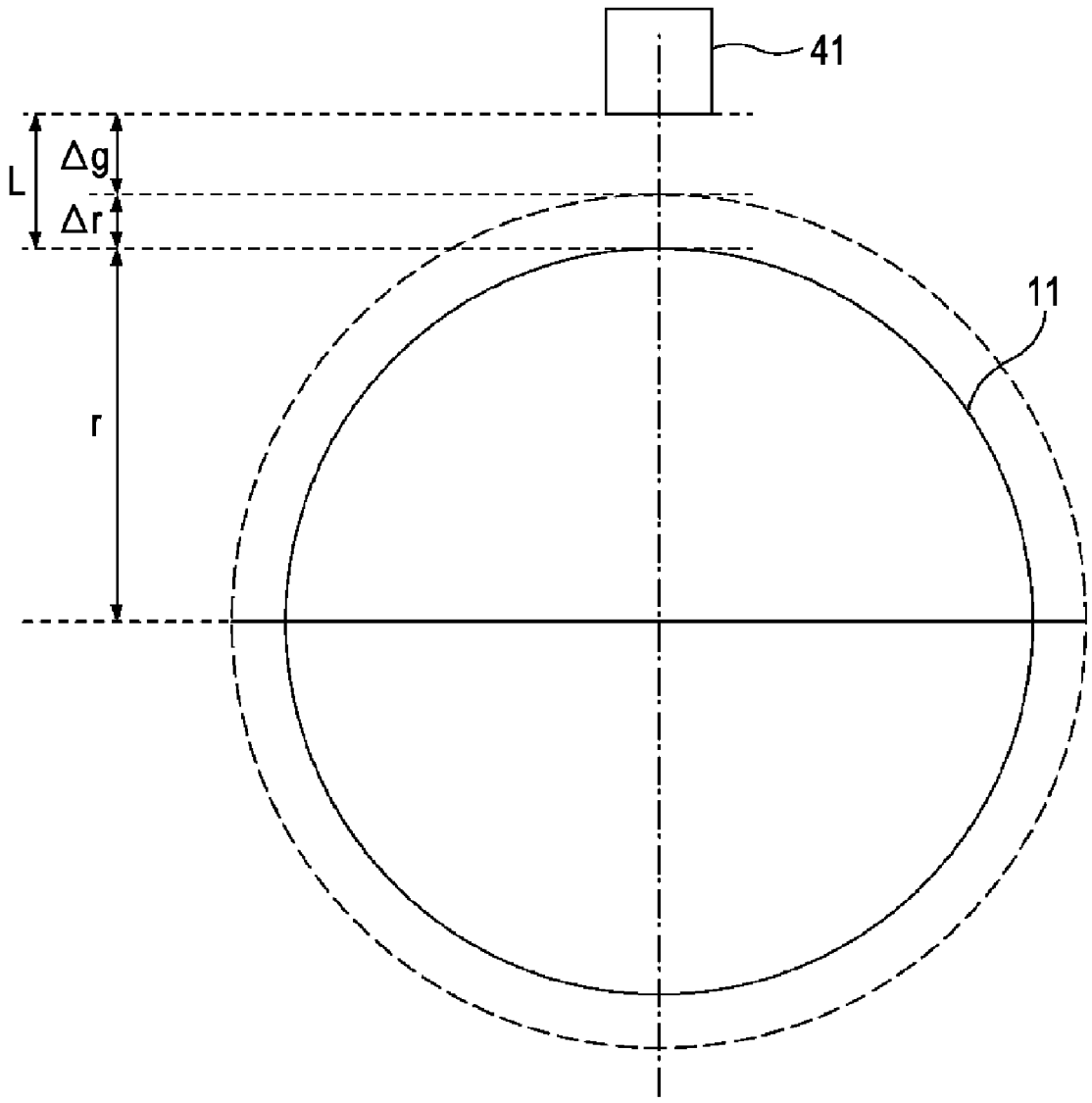
FIG. 12 illustrates how much a head is adjusted in the height direction.

FIG. 12 illustrates how much each head is adjusted in the height direction. In FIG. 12, a solid line indicates the outer surface of the drum 11 when the drum 11 has a reference radius r. The distance from the first head 41 to the outer surface of the drum 11 in this state is denoted by L. A minute amount of expansion of the drum 11 in an expanded state with respect to the reference radius r is denoted by Δr, and the distance from the first head 41 to the outer surface of the drum 11 in this state is denoted by Δg.

When the radius of the drum 11 is equal to the reference radius r, the following equations are satisfied:

$$V1^2 - V0^2 = 2a \cdot L \tag{1.1}$$

$$V1 = V0 + a1 \tag{1.2}$$

where V0 denotes the initial speed of ink ejected from the first head 41, V1 denotes the speed of the ink when reaching the outer surface of drum 11, a denotes the acceleration of the ink, and t1 denotes the time of flight of the ink.

According to the equations (1.1) and (1.2), the following equation can be obtained:

$$(V0 + a \cdot t1)^2 - V0^2 = 2a - L \tag{1.3}$$

Accordingly, $$2V0 \cdot t1 + a \cdot t1^2 = 2 \cdot L \tag{1.4}$$

The acceleration a is a value determined on the basis of the effects of various factors. For example, the acceleration a is a value affected by the initial speed V0. Since the initial speed V0 varies depending on the voltage applied to a piezo element, it is conceivable that the acceleration a is also affected by the waveform of the drive signal COM. Furthermore, since an ejected ink droplet is affected by air resistance during its flight, it is conceivable that the value of acceleration a is also affected by the size and the shape of the ink droplet. The value of acceleration a is also affected by the internal temperature and the humidity in the printer. Furthermore, because the ink is affected by its viscosity when it exits the nozzle face, the value of acceleration a is also affected by the viscosity of the ink.

Next, the following relationships are satisfied:

$$V2^2 - V0^2 = 2a \cdot (L - \Delta r) \tag{2.1}$$

$$V2 = V0 + a \cdot t2 \tag{2.2}$$

where V2 denotes the speed of ink when reaching the outer surface of the drum 11 in an expanded state, and t2 denotes the time of flight of the ink.

According to the equations (2.1) and (2.2), the following equation can be obtained:

$$(V0 + a \cdot t2)^2 - V0^2 = 2a \cdot (L - \Delta r) \tag{2.3}$$

Accordingly, $$2V0 \cdot t2 + a \cdot t2^2 = 2 \cdot (L - \Delta r) \tag{2.4}$$

The acceleration a in this case is also a value determined on the basis of the effects of various factors.

A time of flight t1 of an ink droplet when the drum radius is equal to the reference radius r and a time of flight t2 of an ink droplet when the drum radius is equal to (r+Δr) have the relationship t1>t2. This is because the distance between the head and the outer surface of the drum 11 is smaller when the drum radius is increased from the reference radius r than when the drum radius is equal to the reference radius r.

The peripheral speed of the drum 11 is expressed by the following equation when the drum radius is equal to the reference radius r:

$$Va=r\cdot\omega \tag{3.1}$$

where ω denotes the angular speed of the drum 11. On the other hand, when the drum radius is equal to (r+Δr), the peripheral speed of the drum 11 is expressed by the following equation:

$$Vb=(r+\Delta r)\cdot\omega \tag{3.2}$$

Accordingly, based on when an ink droplet is ejected, the position the ink droplet reaches (i.e., the landing position of the ink droplet in the rotating direction of the drum 11) can be expressed by one of the following equations:

$$L1=Va\cdot t1=(r\cdot\omega)\cdot t1 \tag{4.1}$$

$$L2=Vb\cdot t2=[(r+\Delta r)\cdot\omega]t2 \tag{4.2}$$

where L1 denotes a landing position when the drum radius is equal to the reference radius r, and L2 denotes a landing position when the drum radius is equal to (r+Δr). Consequently, there may be a case where L1≠L2.

Thus, in the case where L1≠L2, a ratio (L2/L1) of positional deviation when the drum 11 is in an expanded state is expressed as follows:

$$L2/L1=[(r+\Delta r)\cdot\omega]\cdot t2/(r\cdot\omega)\cdot t1 \tag{5.1}$$

On the other hand, since (Δr=L−Δg), the following equation is obtained from the equation (5.1):

$$\begin{aligned} L2/L1 &= [r+(L-\Delta g)]\cdot\omega\cdot t2/(r\cdot\omega)\cdot t1 \\ &= [r+(L-\Delta g)]\cdot t2/r\cdot t1 \end{aligned} \tag{5.2}$$

When L2/L1=1, an ink droplet can land on the sheet S without the occurrence of positional deviation. Thus, $$L2/L1=[r+(L-\Delta g)]\cdot t2/r\cdot t1=1$$

Accordingly, $$\Delta g=[(t1/t2)-1]\cdot r+L \tag{6.1}$$

In consequence, in this embodiment, the height of the head unit 40 is adjusted by the height adjusting mechanism 20 so that Δg satisfies the equation (6.1).

The outer radius of the drum 11 at every predetermined location thereof can be obtained by the outer-radius measuring device 52. The peripheral speed of the drum 11 can be obtained by the peripheral-speed measuring device 53 at every predetermined time. Based on these obtained measured values, the controller 60 adjusts the height of the head unit 40 and causes it to eject ink so as to perform printing. Accordingly, the ink can land on the medium without the occurrence of positional deviation.

As an alternative to the outer-radius measuring device 52 attached to the carriage 31 in the above embodiment, two outer-radius measuring units 52' may be attached to two opposite ends of the drum 11 in the axial direction, respectively (see FIG. 1). In that case, these units are configured to obtain outer radii at the respective opposite ends of the drum 11. With regard to the outer radius of the drum 11 across the main scanning direction between the two outer-radius measuring units 52', the outer radius can be determined by interpolation from the measured values of the two units.

Although the head unit 40 and the ultraviolet-light-emitting unit 90 are configured to be moved in the main scanning direction, the head unit 40 and the ultraviolet-light-emitting unit 90 may alternatively be provided in a plurality. In that case, these units may be arranged in the main scanning direction. Even in that case, the outer radius of the drum 11 will vary in different regions thereof if the emission rate of ultraviolet light varies for these regions, as described above. However, since the height of the head unit 40 can be adjusted on the basis of a measured outer radius of the drum 11 and a measured linear speed at the periphery of the drum 11, a proper image can be formed.

Although printing is performed by moving the head unit 40 and the ultraviolet-light-emitting unit 90 simultaneously in the main scanning direction in the above embodiment, the head unit 40 and the ultraviolet-light-emitting unit 90 do not necessarily need to be moved simultaneously. The ultraviolet-light-emitting unit 90 may be configured to move in the main scanning direction while following the positions to which ink droplets are ejected. Therefore, the ultraviolet-light-emitting unit 90 may be configured to move in the main scanning direction slightly after the movement of the head unit 40.

Other Embodiments

Although the above embodiment is directed to an inkjet printer as an example of a fluid ejecting apparatus, the fluid ejecting apparatus is not limited and may include a fluid ejecting apparatus that ejects or emits a liquid other than ink (such as a liquid containing dispersed particles of functional materials or a fluid such as gel) or a fluid other than liquids (such as a solid that can be poured and ejected in the form of a fluid). Examples of such a fluid ejecting apparatus include a liquid ejecting apparatus that ejects a liquid containing an electrode material or a colorant in a dispersed or dissolved state used for manufacturing liquid crystal displays, electroluminescence (EL) displays, and field emission displays, a liquid ejecting apparatus that ejects a liquid containing a bioorganic compound used for manufacturing biochips, and a liquid ejecting apparatus that ejects a liquid to form a sample used as a precision pipette. Furthermore, the invention is also applicable to a liquid ejecting apparatus that ejects lubricating oil to precision devices, such as watches and cameras, with pinpoint accuracy, a liquid ejecting apparatus that ejects a transparent resin liquid, such as ultraviolet curable resin, onto a substrate to form micro hemispherical lenses (optical lenses) used in optical communication devices or the like, a liquid ejecting apparatus that ejects an acidic or alkali etching solution for etching a substrate or the like, a fluid ejecting apparatus that ejects gel, or a fine-particle-ejecting-type recording apparatus that ejects a solid as an example of fine particles, such as toner. The invention can be applied to any of the ejecting apparatuses of these types.

In the above embodiment, the ink is not limited to UV ink. In that case, the ultraviolet-light-emitting unit 90 may be a heater for facilitating dehydration of the ink. The ink in this case may include water-based ink or oil-based ink.

The above-described embodiment is only intended to provide an easier understanding of the invention but not to limit the invention. Various modifications and changes are permissible so long as they do not depart from the scope of the invention, and equivalents thereof are included in the invention.

What is claimed is:

1. A fluid ejecting apparatus comprising:

a rotatable drum that holds a medium on a periphery thereof;

a head that ejects a fluid onto the medium held by the drum;

a fixing portion that fixes the fluid ejected from the head onto the medium;

an outer-radius measuring portion that measures an outer radius of the drum;

a peripheral-speed measuring portion that measures a peripheral speed at the periphery of the drum corresponding to an outer radius thereof;

an adjusting portion that adjusts a distance between the drum and the head; and a controller that causes the adjusting portion to adjust a distance between the head and the medium while the drum is rotating to account for changes in the outer radius of the drum measured by the outer-radius measuring portion and in the peripheral speed measured by the peripheral-speed measuring portion.

2. The fluid ejecting apparatus according to claim 1, wherein the fixing portion is a light-emitting device.

3. The fluid ejecting apparatus according to claim 1, wherein the fixing portion is an ultraviolet-light-emitting device.

4. The fluid ejecting apparatus according to claim 1, wherein a change in the distance between the head and the medium when the outer radius of the drum has changed is given by the equation $$\Delta g=[(t1/t2)-1]\cdot r+L$$

where

Δg is the change in the distance between the head and the medium when the outer radius of the drum has changed;

t1 is the time of flight of the fluid to the medium with the drum having a reference outer radius;

t2 is the time of flight of the fluid to the medium with the drum having the changed outer radius;

r is a reference outer radius of drum; and

L is a distance from the head to the medium with the drum having the reference outer radius.

5. A fluid ejecting method comprising:

rotating a medium while holding the medium on a periphery of a drum;

ejecting a fluid from a head onto the medium held by the drum;

fixing the fluid ejected from the head onto the medium;

measuring a peripheral speed at the periphery of the drum corresponding to an outer radius thereof;

measuring the outer radius of the drum; and adjusting a distance between the head and the medium while the drum is rotating to account for changes in the outer radius of the drum and in the measured peripheral speed at the periphery of the drum corresponding to the outer radius thereof.

6. The fluid ejecting apparatus according to claim 5, wherein a change in the distance between the head and the medium when the outer radius of the drum has changed is given by the equation $$\Delta g=[(t1/t2)-1]\cdot r+L$$

where

Δg is the change in the distance between the head and the medium when the outer radius of the drum has changed;

t1 is the time of flight of the fluid to the medium with the drum having a reference outer radius;

t2 is the time of flight of the fluid to the medium with the drum having the changed outer radius;

r is a reference outer radius of drum; and

L is a distance from the head to the medium with the drum having the reference outer radius.

* * * * *